United States Patent [19]

Lickert

[11] Patent Number: 4,489,452

[45] **Date of Patent: * Dec. 25, 1984**

[54] PRENATAL MATTRESS

[76] Inventor: Jodey J. Lickert, 8964 Whitewood, Temperance, Mich. 48182

[ * ] Notice: The portion of the term of this patent subsequent to May 10, 2000 has been disclaimed.

[21] Appl. No.: 424,749

[22] Filed: Sep. 27, 1982

Related U.S. Application Data

[63] Continuation-in-part of Ser. No. 303,536, Sep. 18, 1981, Pat. No. 4,382,306.

[51] Int. Cl.[3] ..... A47C 27/08; A47G 9/00

[52] U.S. Cl. ..... 5/465; 5/455

[58] Field of Search ..... 5/465, 462, 441, 431, 5/436, 449, 450, 451, 455, 470, 420, 485

[56] References Cited

U.S. PATENT DOCUMENTS

| | | | |
|---|---|---|---|
| 1,595,698 | 8/1926 | Wilson | 5/441 |
| 3,118,152 | 1/1964 | Talley | 5/462 |
| 3,287,747 | 11/1966 | Ellsworth | 5/462 |
| 3,848,281 | 11/1974 | Mathews | 5/434 |
| 4,163,297 | 8/1979 | Neumark | 5/455 |
| 4,231,125 | 11/1980 | Tittl | 5/485 |
| 4,382,306 | 5/1983 | Lickert | 5/465 |
| 4,397,052 | 8/1983 | Lund | 5/462 |

FOREIGN PATENT DOCUMENTS

| | | | |
|---|---|---|---|
| 258077 | 9/1926 | United Kingdom | 5/441 |
| 1093969 | 12/1967 | United Kingdom | 5/485 |

*Primary Examiner*—Alexander Grosz

*Attorney, Agent, or Firm*—James L. Wilcox

[57] ABSTRACT

A prenatal mattress enabling a pregnant woman to lie more comfortably and safely upon her abdomen during the pregnancy term is disclosed. The mattress can comprise a lower layer of cloth carrying releasable fasteners, a fluid-fillable abdominal cushion, a fluid-fillable head cushion, an upper layer of cloth, and various combinations thereof. The abdominal and head cushions can be disposed in appropriate locations between the lower and upper cloth layers to support the respective portions of the body of a particular user. The cushions can be filled to an extent desired with a suitable fluid, placed between the layers and attached to the fasteners carried by the lower layer by means of coordinating fasteners carried on lower surfaces of each cushion. In use, a pregnant woman can lie frontally downwardly upon the mattress, her abdomen and head being placed upon their respective cushions.

12 Claims, 4 Drawing Figures

PRENATAL MATTRESS

REFERENCE TO RELATED APPLICATION

This is a continuation-in-part of application Ser. No. 303,536, filed Sept. 18, 1981, now, U.S. Pat. No. 4,382,306.

BACKGROUND OF THE INVENTION

This invention relates to apparatus for providing physical comfort and safety during human pregnancy, and more particularly relates to a mattress which enables a pregnant woman to lie frontally downwardly on her abdomen throughout the prenatal period with a minimum of discomfort and a maximum of safety. Heretofore, it has generally been thought to be necessary to minimize, during the prenatal period, the amount of time pregnant women rest in a position where their distended abdomens are forced against a relatively non-compliant surface, for example that of a conventional mattress. Both the safety of the fetus and the comfort of the woman may be compromised when she is forced to lie frontally downwardly, particularly for extended periods of time during the latter stages of pregnancy. Accordingly, a need has arisen for a simply constructed, economical mattress upon which an expectant mother can lie in such a position for a desired length of time without suffering excessive physical discomfort or causing injury to the fetus.

SUMMARY OF THE INVENTION

The instant invention is based upon the discovery of a mattress upon which a pregnant woman can lie safely in a frontally-downward position, providing the advantage of a maximum of comfort for the user while minimizing the possibility of the fetus being crushed between a comparatively non-compliant surface and the body of the user. Such a mattress according to the invention can comprise:

(a) an upper layer comprising a longitudinally-extending sheet of flexible material having substantially planar upper and lower surfaces and opposed ends;

(b) a lower layer comprising a longitudinally-extending sheet of flexible material having substantially planar upper and lower surfaces and opposed ends, the lower layer being securely attached to the upper layer along a portion of the edges and one end of each of the layers;

(c) a first substantially resilient cushion, having a substantially centrally-located hole and disposed between the first and second layers at a suitable location for providing support for the abdomen of the user;

(d) first releasable fastening means carried by the upper and lower layers along adjacent edges thereof for detachably joining the layers so that the cushion is disposed between the layers; and (e) second releasable fastening means carried by the lower layer and the cushion for detachably securing the cushion to the lower layer.

Additionally, the mattress can include a second substantially resilient cushion, disposed longitudinally of the first resilient cushion, for supporting the head of a user. Preferably, either or both of the cushions comprise hollow members which are fluid-fillable, and, in use, contain a fluid, for example air or water. Alternatively, the cushions can comprise solid members of resilient material. Desirably, the releasable fastening means are hook-and-loop fasteners and the material of the upper and lower layers is made of absorbent cotton.

Another mattress according to the invention can comprise:

(a) a layer of flexible material having substantially planar upper and lower surfaces;

(b) a substantially resilient cushion, said cushion having a substantially centrally-located hole and being detachably joined to said layer in a suitable location and of such a shape that said cushion provides support for the abdomen of the user; and (c) releasable fastening means carried by said layer for detachably joining said cushion to said layer so that said cushion is disposed in the suitable location.

Additionally, the last-described mattress can include a second layer of flexible material, said second layer being securely attached to said first-named layer along one end of each of said layers, and second releasable fastening means carried by said second layer and said cushion for detachably securing said cushion to said second layer.

Accordingly, it is an object of the instant invention to provide a prenatal mattress having the structure and advantages described above.

Other objects and advantages of the invention will be apparent from the description which follows, reference being made to the accompanying drawings. The description is intended only to illustrate and disclose, and in no way to limit the invention as defined in the claims appended hereto.

DETAILED DESCRIPTION OF THE INVENTION

Figure 1:
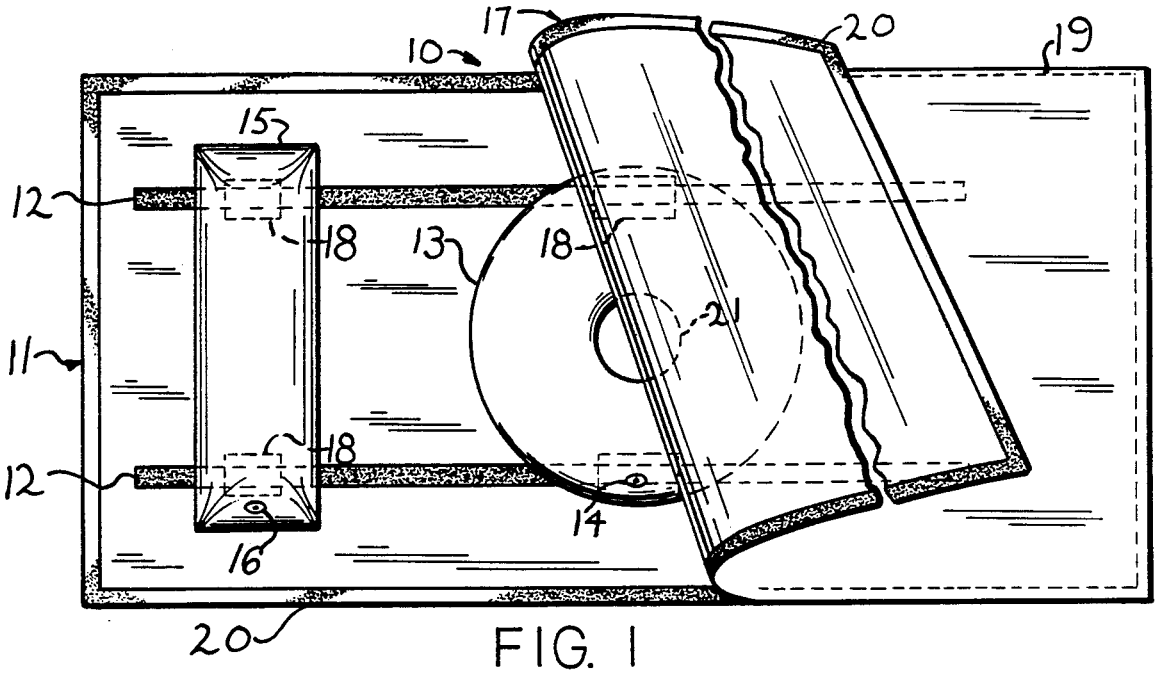
FIG. 1 is a top plan view of a prenatal mattress according to the invention, with a top layer thereof partially folded back to show details of construction.

With reference first to FIG. 1 of the drawings, a preferred embodiment of a prenatal mattress according to the invention is indicated generally at 10. The mattress 10 comprises a rectangular, lower layer of cloth 11 made of moisture-absorbent cotton. The lower layer 11 carries two elongated hook-and-loop fastening strips 12 mounted thereupon which are sold under the Tradename "Velcro", and upon which a cushion 13, which is a hollow, resilient, substantially ring-shaped rubber member having a centrally-located hole 21 extending therethrough, is disposed. The cushion 13 can be filled with a suitable fluid, for example water, through a conventional valve 14. As illustrated in the drawing figures, a second hollow, resilient and substantially rectangular rubber cushion 15, which also can be filled with a suitable fluid through a conventional valve 16, may be disposed upon the hook and loop type strips 12 longitudinally of the cushion 13. A rectangular, upper layer of cloth 17 is situated so as to cover upper surfaces of the cushions 13 and 15 and is also made of absorbent cotton.

Figure 2:
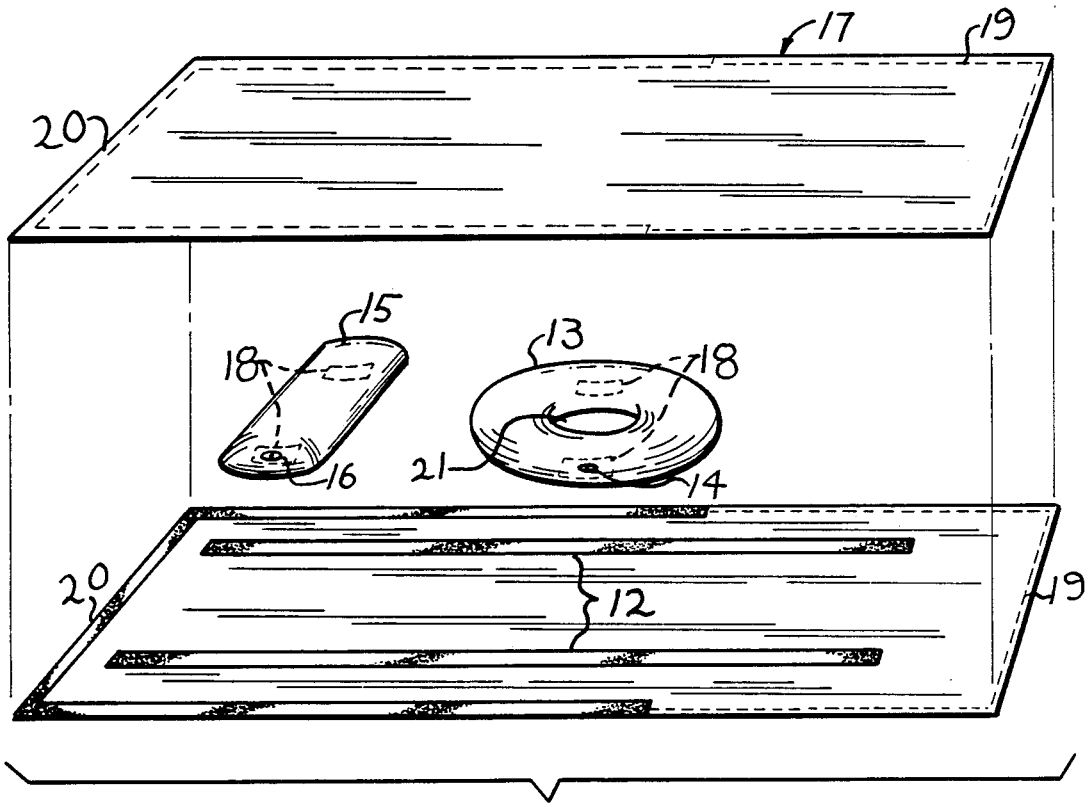
FIG. 2 is an exploded perspective view of the prenatal mattress shown in FIG. 1.

As illustrated in FIGS. 1 and 2, the cushions 13 and 15 are each disposed upon the hook and loop type strips 12 mounted upon the lower layer 11 and are between the lower cloth layer 11 and the upper cloth layer 17. The cushions 13 and 15 are held releasably engaged to the hook and loop type strips 12 by means of suitably-located hook and loop type fasteners 18 affixed to a lower surface of each, in positions which coordinate with the location and spacing of the strips 12. Peripheral edges of the layers 11 and 17 are partially sewn together along approximately one-third of their lengths and along adjacent ends, as indicated at 19. Coordinating hook and loop type fasteners are carried by the remaining edges of the layers 11 and 17, as indicated at 20, so that the layers 11 and 17 are detachably joinable along these edges when the mattress 10 is fully assembled.

In use of the prenatal mattress 10, a user, typically a pregnant woman, will fill the cushion 13 with a suitable fluid through the valve 14. Such a fluid can be, for example, water, air, or any relatively inert and non-toxic liquid or gas. The cushion 15 will be similarly filled with a suitable fluid, through the valve 16. Both of the cushions 13 and 15 will be thus filled to an extent necessary to provide a desired degree of resiliency and compliancy to the body of the user. The user will then place the fluid-containing cushions 13 and 15 between the partially-separated lower and upper layers 11 and 17, observing care in aligning the hook and loop type fasteners 18 affixed to the lower surfaces of each cushion with the coordinating Velcro strips 12 on the lower layer 11, so that the cushions 13 and 15 are suitably positioned for support of the body weight of the user; the cushion 13 thus will be detachably secured to the layer 11 in a position for cushioning and conforming to the contours of the abdomen of the user when the abdomen is placed into the center hole 21 thereof, and the cushion 15 will be similarly detachably secured to the layer 11 in a position for cushioning the head of the user.

The cushions 13 and 15 thus will be spaced apart from one another as necessary on the strips 12, preferably disposed in those positions in which the distance between their geometrical centers corresponds approximately to the distance between the center of the head and the center of the abdomen of the user, and then will be secured, by contact of the coordinating hook and loop type fasteners 18 and 12, in the appropriate positions. The fasteners 20 carried by the layers 11 and 17 will then be brought into contact and the layers 11 and 17 thus secured together to complete assembly of the mattress 10.

Figure 3:
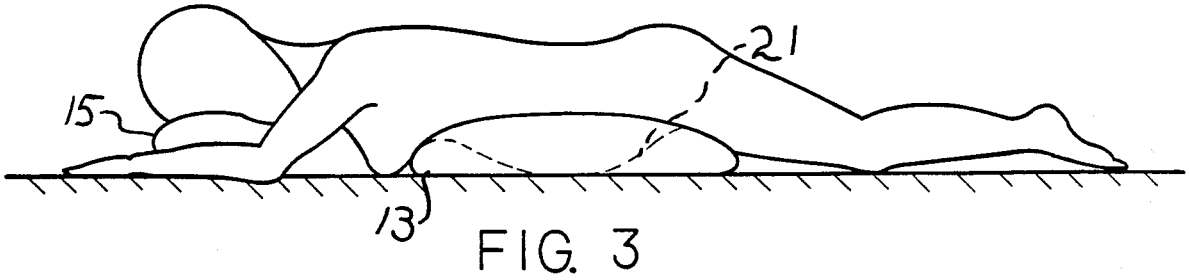
FIG. 3 is a side view of the mattress shown in FIGS. 1 and 2, and further showing a typically pregnant woman lying thereupon.

FIG. 3 illustrates how a pregnant user will lie in a frontally-downward position on a prenatal mattress according to the instant invention, placing her distended abdomen in a position centered generally within the center hole 21 (shown by hidden line) of the abdominal cushion 13, and placing her head on the head cushion 15. Both of the cushions 13 and 15 will be filled with fluid to an appropriate level, to provide a desired degree of comfort to the user; as shown, the cushions 13 and 15 will respond compliantly to the body of the user when she is so resting thereupon.

It will be appreciated that, in use of the prenatal mattress 10, each component thereof will contribute to enable, in combination, its overall usefulness and effectiveness in providing a pregnant woman with greater comfort and safety while lying frontally downwardly thereupon. For example:

1. The lower layer 11 provides a surface for attachment of the fastener strips 12 so that the cushions 13 and 15 can be secured in their respective, appropriate locations, and further provides a protective covering for lower surfaces of the cushions 13 and 15. Additionally, when made from absorbent cloth, the lower layer 11 can provide moisture absorption during use.

2. The elongated fastening strips 12 provide means for detachably securing the cushions 13 and 15 in appropriate locations between the lower and upper layers 11 and 17, and enable adjustment of the cushions 13 and 15 along the length of the strips 12 to suitable locations corresponding to the physical proportions of any particular individual user.

3. When the mattress 10 is in use, the fluid-filled cushion 13, being resilient and substantially ring-shaped, enables a pregnant user to rest comfortably by allowing her distended abdomen to fit generally within the center hole 21, even when the cushion 13 is filled only partially. Alternatively, a cushion similar to the cushion 13 can be formed of any suitable solid, resilient material, for example foam rubber. Whatever material is used to form such a cushion, if a major proportion of the weight of both the abdomen and the remainder of the body of the user are appropriately placed near its geometrical center, the fluid or solid, resilient material will be forced outwardly, thereby slightly distending the outer walls of the cushion and raising slightly areas of the body of the user adjacent to the abdomen, such as the upper thigh area, the rib area and the hip area. The cushion, therefore, is able to conform to the contours of the distended abdomen, alleviating pressure thereon which might otherwise result from the abdomen being forced against a relatively non-compliant surface, such as that of a conventional mattress—which could result not only in discomfort to the user, but also injury to the fetus. In addition, when fluid-filled, the cushion 13 can be adjusted to progressive growth of the abdomen during the pregnancy term merely by varying the volume of fluid used therein. For example, a substantially circular, rubber ring such as a conventional inner-tube, can be used to form the cushion 13. Such a tube can have, for example, a nominal outside diameter of twenty inches, a center hole nominally eight inches in diameter and a total fluid capacity of about ten quarts of water, total capacity being the maximum which will not noticably distend the walls of the tube. In this case, the cushion 13 preferably should be filled with fluid so that it contains about 20–30 percent of its total capacity. However, the optimum percentage, in any particular case, of fill of an inner-tube cushion 13 having the foregoing dimensions and capacity is extremely variable and will depend, for example, upon such factors as the weight, body build and degree of distension of the abdomen of the individual user. The greatest advantages from the use of a mattress in accordance with the invention which incorporates such an inner-tube as the cushion 13 will be achieved if the tube is filled with fluid to within the lower portion of the aforementioned volume range during the later stages of a pregnancy, and to within the higher portion of that range during earlier stages thereof. For example, a fill level of substantially 25 percent total volume capacity for an inner-tube having the aforementioned dimensions and capacity may be considered a typical level for an average user about six months into the pregnancy term.

4. The resilient cushion 15 provides a headrest for the user. The cushion 15 can, similarly to the cushion 13, be of largely conventional, hollow construction and fluid-fillable, or of solid construction; when fluid-fillable, a user can fill it to a level which will provide a desired degree of comfort during use.

5. The upper layer 17 provides a protective covering for upper surfaces of the cushions 13 and 15 and, when made from absorbent cloth, can provide absorption of moisture during use.

As an example, in fabricating a prenatal mattress according to the invention, such as that illustrated in FIGS. 1 and 2 of the drawings, two elongated hook and loop type strips will be spaced substantially parallel upon and then securely attached, for example by gluing or sewing, to the upper surface of a substantially rectangular sheet of absorbent cotton fabric forming a lower layer. All edges of the sheet will be coordinated with the edges of another cotton sheet of substantially the same shape and dimensions, and forming an upper layer. The edges of both sheets will then be stitched together a distance of approximately one-third of the length of their sides and along an adjacent end of each. Coordinating hook and loop type fasteners will then be securely attached, for example, by gluing or sewing, to the inside edges of each sheet which have not been previously sewn.

Any suitable conventional materials and procedure will be used to fabricate the abdominal cushion of the mattress. For example, a conventional, substantially circular piece of heat-sealable, heavy-gauge rubber or plastic which has a circular center hole therein and which incorporates a conventional, two-way valve for sealing against fluids will be placed in direct alignment over another such piece having substantially the same composition, shape and dimensions, but not having such a valve. The coordinated pieces will then be brought together and sealed permanently, around their outer edges and around their edges which form the outer circumference of their center holes, using a conventional heat-sealing process. Two strips of hook and loop type fastening material will then be attached securely to lower surfaces of the assembled cushion, for example, by gluing; the strips will be spaced apart, one on each side of the center hole, so that they are substantially parallel to one another at a distance equal to the distance between the elongated Velcro strips attached to the upper surface of the lower sheet.

Conventional materials and procedures will also be used to form the head cushion used in the mattress of the invention, for example as described in the foregoing paragraph. Two strips of hook and loop type fastening material will then be attached securely, for example by gluing, to the lower surface of the assembled head cushion, and spaced apart so that they are substantially parallel to one another at a distance about equal to the distance between the elongated Velcro strips on the upper surface of the lower sheet.

It will be appreciated that various changes and modifications to the instant invention will be possible in addition to those described above, such as to the preferred embodiment of the invention described herein and illustrated in the drawings, for example:

(a) The releasable fasteners 18 on the lower surfaces of the cushions 13 and 15, those secured to the edges of the lower and upper layers 11 and 17, as indicated at 20, and the elongated fastening strips 12 on the lower layer 11 have been described as being made of hook and loop type, a particular brand of hook-and-loop fastening material. However, other brands and types of conventional releasable fasteners could also be used, including, for example, mechanical snaps, zippers, buttons or similar fasteners. In the case of fastening of the edges of the layers as at 20, zippers can be used most conveniently.

(b) Both of the lower and upper layers 11 and 17 of the mattress 10 have been described as being composed of cotton cloth. It will be understood, however, that any other suitable material, for example nylon or various plastics, could be used as a material for such layers. Also a single layer of material, for example, covering only upper surfaces of the cushions 13 and 15, might be employed in the mattress 10. If only a single, upper layer is used, the elongated fastening strips 12 would then be situated upon and attached to the lower surfaces thereof, to coordinate with the fasteners 18 on the cushions. In addition, one elongated sheet of material could be used in fabricating a mattress according to the invention, and, for example, carrying Velcro strips which extend for substantially one-half of its longest dimension, the other one-half of the sheet being folded over to cover completely the cushions 13 and 15. However, two separate, lower and upper layers of cloth, for example as shown at 11 and 17, are preferred for use in a mattress according to the invention over either of the variations described above. Utilizing a single covering layer, for example, would provide no protection for remaining exposed surfaces of the cushions; an elongated, folded sheet would probably be somewhat awkward for a user to handle, and also decrease the portability of the mattress.

(c) Variations are possible in the manner in which the upper and lower layers of a mattress of the invention are joined together at their edges where releasable fasteners are not used. In the foregoing description, in reference to the drawings, such edges of these layers 11 and 17 are described as sewn together at 19, however, they could be heat-sealed, or sealed in any other suitable, conventional manner, so long as the layers are securely joined so that they cannot readily be taken apart.

Figure 4:
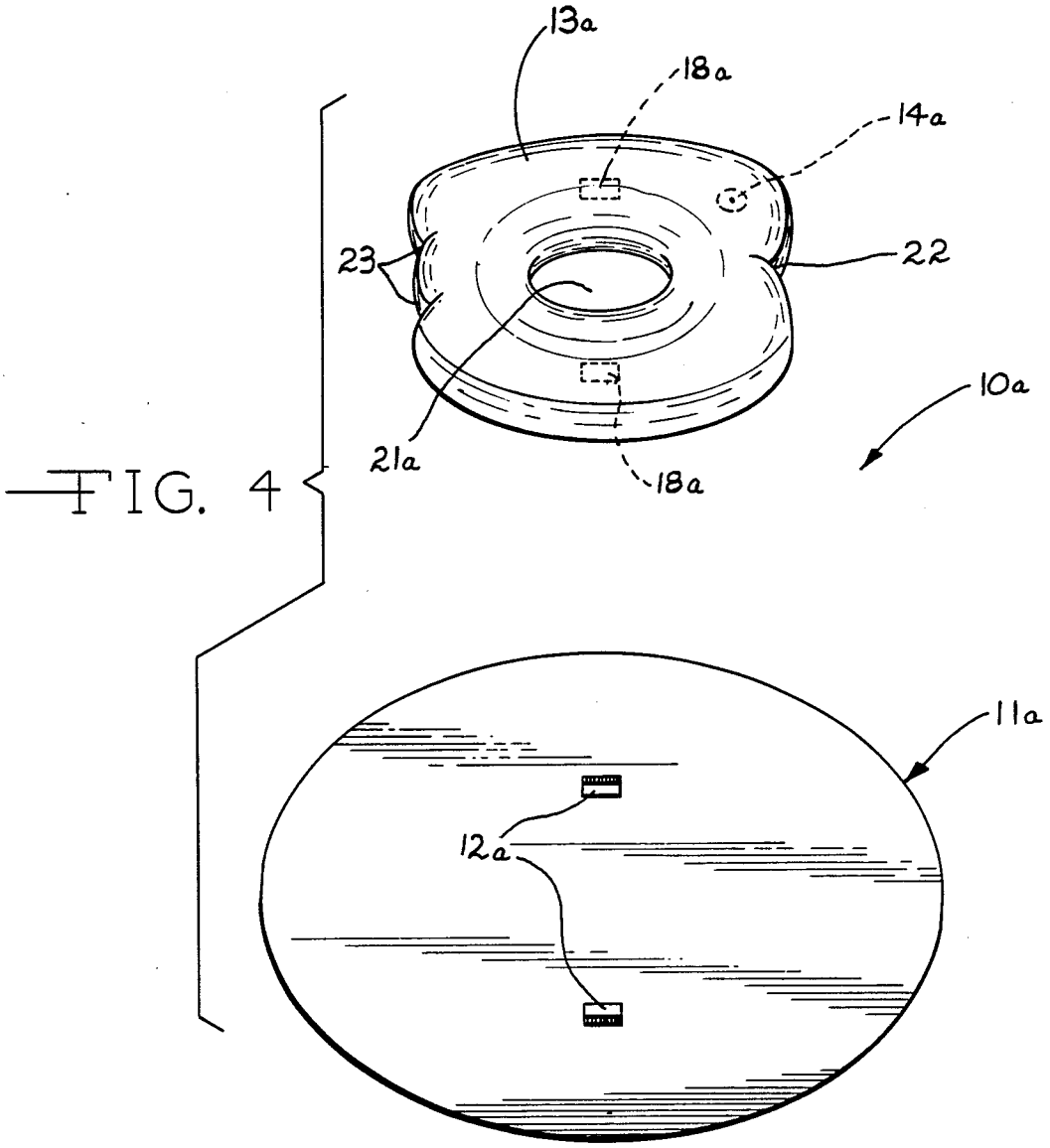
FIG. 4 is an exploded perspective view of another embodiment of a prenatal mattress according to the invention.

Referring now to FIG. 4, another embodiment of a prenatal mattress is indicated generally at **10*a*. The mattress 10*a* comprises a somewhat circular or polygonal, lower layer of cloth 11*a* made of moisture-absorbent cotton. The lower layer 11*a* carries two elongated hook-and-loop-fasteners 12*a* mounted thereupon which are sold under the tradename "Velcro", and upon which a cushion 13*a*, which is a hollow, resilient, substantially polygonal-shaped rubber member having a centrally-located hole 21*a* extending therethrough, is disposed. The cushion 13*a* can be filled with a suitable fluid, for example water, through a conventional valve 14*a***.

To be of a suitable shape for providing support for the legs of a pregnant user, one peripheral portion of the cushion **13*a* is provided with a single indentation 22 approximately two inches deep; directly opposed therefrom another peripheral portion of the cushion 13*a* is provided with a double indentation 23** about two inches deep for fitting the contours of the breast area of the user.

The cushion **13*a* is held releasably engaged to the fasteners 12*a* by means of suitably-located hook and loop type fasteners 18*a* affixed to its lower surface, in positions which coordinate with the location and spacing of the strips 12*a***.

Since the other aspects of the mattress 12 have been previously described, for the other embodiments thereof no further discussion is deemed necessary.

It will be appreciated that numerous additional modifications can be made in the specific embodiments and disclosure of the invention herein without departing from the spirit and scope thereof as defined in the following claims.

I claim:

1. A prenatal mattress, especially for supporting the abdomen and other portions of the body of a pregnant user lying frontally-downwardly thereupon, comprising:

(a) a layer of flexible material having substantially planar upper and lower surfaces;

(b) a substantially resilient cushion, said cushion being of one-piece construction, having a substantially centrally-located hole and being capable of being detachably joined to said layer in a predetermined position and of such a shape that said cushion provides support for the abdomen of the user;

(c) releasable fastening means carried by said layer for detachably joining said cushion to said layer so that said cushion is fixed in the predetermined position; and a second layer of flexible material, said first named and second layers being of substantially the same size and shape, and being adapted to be attached to each other, thereby fixing said resilient cushion in the predetermined position.

2. The prenatal mattress according to claim 1, further comprising second releasable fastening means carried by said first layer named.

3. The prenatal mattress according to claim 2, further comprising a substantially resilient cushion disposed longitudinally of said first-named cushion for providing support for the head of the user.

4. The prenatal mattress according to claim 3, wherein said first-named cushion comprises a solid member of resilient material.

5. The prenatal mattress according to claim 3, wherein said first-named cushion comprises a hollow member which contains a fluid.

6. The prenatal mattress according to claim 5, wherein said fluid is a gas.

7. The prenatal mattress according to claim 5, wherein said fluid is a liquid.

8. The prenatal mattress according to claim 2, wherein each of said releasable fastening means comprises coordinating hook-and-loop fasteners.

9. The prenatal mattress according to claim 2, wherein each of said releasable fastening means comprises a zipper.

10. The prenatal mattress according to claim 2, wherein the material of said layers is moisture absorbent.

11. The prenatal mattress according to claim 10, wherein said absorbent material is cotton.

12. The prenatal mattress according to claim 1, wherein said resilient cushion is adapted additionally for providing support for the legs and for fitting the contours of the breast area of the user.

* * * * *